US010137331B1

(12) United States Patent
Al-Otaibi et al.

(10) Patent No.: US 10,137,331 B1
(45) Date of Patent: Nov. 27, 2018

(54) SWIMMING FIN FOR THE DISABLED

(71) Applicants: Dhari M. M. A. M. Al-Otaibi, Safat (KW); Yousef A. Q. GH. Alnaser, Safat (KW)

(72) Inventors: Dhari M. M. A. M. Al-Otaibi, Safat (KW); Yousef A. Q. GH. Alnaser, Safat (KW)

( * ) Notice: Subject to any disclaimer, the term of this patent is extended or adjusted under 35 U.S.C. 154(b) by 0 days.

(21) Appl. No.: 16/056,327

(22) Filed: Aug. 6, 2018

Related U.S. Application Data

(60) Provisional application No. 62/567,241, filed on Oct. 3, 2017.

(51) Int. Cl.
*A63B 31/12* (2006.01)
*A63B 31/11* (2006.01)

(52) U.S. Cl.
CPC ..... *A63B 31/12* (2013.01); *A63B 2031/112* (2013.01)

(58) Field of Classification Search
CPC ..... A63B 31/00; A63B 31/12; A63B 31/18
USPC ..... 441/56, 60, 61
See application file for complete search history.

(56) References Cited

U.S. PATENT DOCUMENTS

| | | | | |
|---|---|---|---|---|
| 3,405,413 | A * | 10/1968 | Manis | A63B 31/18 441/60 |
| 4,209,866 | A | 7/1980 | Loeffler | |
| 5,417,599 | A | 5/1995 | Evans | |
| D561,863 | S | 2/2008 | Moyal | |
| 9,457,231 | B2 | 10/2016 | Rodgers, Jr. | |
| 2010/0075554 | A1 | 3/2010 | Johnson | |
| 2017/0007888 | A1 | 1/2017 | Stroud | |

FOREIGN PATENT DOCUMENTS

| | | |
|---|---|---|
| WO | 03/05186 A1 | 5/2003 |
| WO | 2016/094930 | 6/2016 |

* cited by examiner

*Primary Examiner* — Lars A Olson
(74) *Attorney, Agent, or Firm* — Richard C. Litman

(57) ABSTRACT

The swimming fin for the disabled includes a flipper pivotally attached to a lower end of a post, the post having a handle on the end opposite the flipper. A strap is pivotally attached to a middle section of the post for securing the post to a user's leg. A user attaches the device to themselves by inserting their foot in the flipper, connecting the strap to their leg, and gripping the handle. When in the water, pushing the handle out from a user's chest and then pulling the handle back to the chest will cause a motion in the user's leg similar to a leg kick, thus allowing a user with limited or no function in their legs to propel him/herself in the water.

9 Claims, 3 Drawing Sheets

SWIMMING FIN FOR THE DISABLED

CROSS-REFERENCE TO RELATED APPLICATION

This application claims the benefit of U.S. Provisional Patent Application Ser. No. 62/567,241, filed Oct. 3, 2017.

FIELD OF THE INVENTION

The present invention relates to swim fins, and more particularly to a swimming fin for the disabled that provides a leg-mounted swimming accessory for physically challenged individuals designed and constructed to assist the disabled to swim.

DESCRIPTION OF THE RELATED ART

Typical swim fins are worn on the foot of a swimmer to aid movement through the water while surface swimming or participating in swimming-related activities, such as bodyboarding, bodysurfing, snorkeling, and various types of underwater diving. For example, scuba divers use swim fins to move through water efficiently, as human feet provide relatively poor thrust, especially when the diver is carrying equipment that increases hydrodynamic drag.

Typical swim fins have several problems. For example, since typical swim fins attach only to the foot and heel of a swimmer, typical swim fins can cause severe ankle strain and calf muscle fatigue. This is due to the mass of water moved by the fin and the fact that the ankle joint rotates through a complex, non-planar, arc. Further, the ankle does not generally orient the foot optimally for forward thrust, thus reducing the efficiency of the hydrofoil properties of the fin. Further, typical swim fins increase the footprint of the swimmer and are constructed of heavy and bulky materials, thus making it difficult to walk, as is often necessary when entering or exiting water via a shoreline, a boat, or a dock. These difficulties are all exacerbated when the user is disabled.

Unfortunately, there are no suitable fins for helping a person with disabled legs to swim more efficiently. Thus, a swimming fin for the disabled solving the aforementioned problems is desired.

SUMMARY OF THE INVENTION

The swimming fin for the disabled is a swimming flipper pivotally mounted to the lower end of an elongated adjustable-length post having a handle at its upper end for controlling movement of the fin. The upper half of the post has a 45° medial bend to place the handle closer to the user's upper body so that the handle is at a position more accessible by the user. The post is attachable to a user's leg by means of a pivotally attached elastic leg tie or strap. Pushing the upper .end of the post away from the user and then pulling the upper end towards the user bends and straightens the lower end of the user's leg in a leg kick to propel the user in the water.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
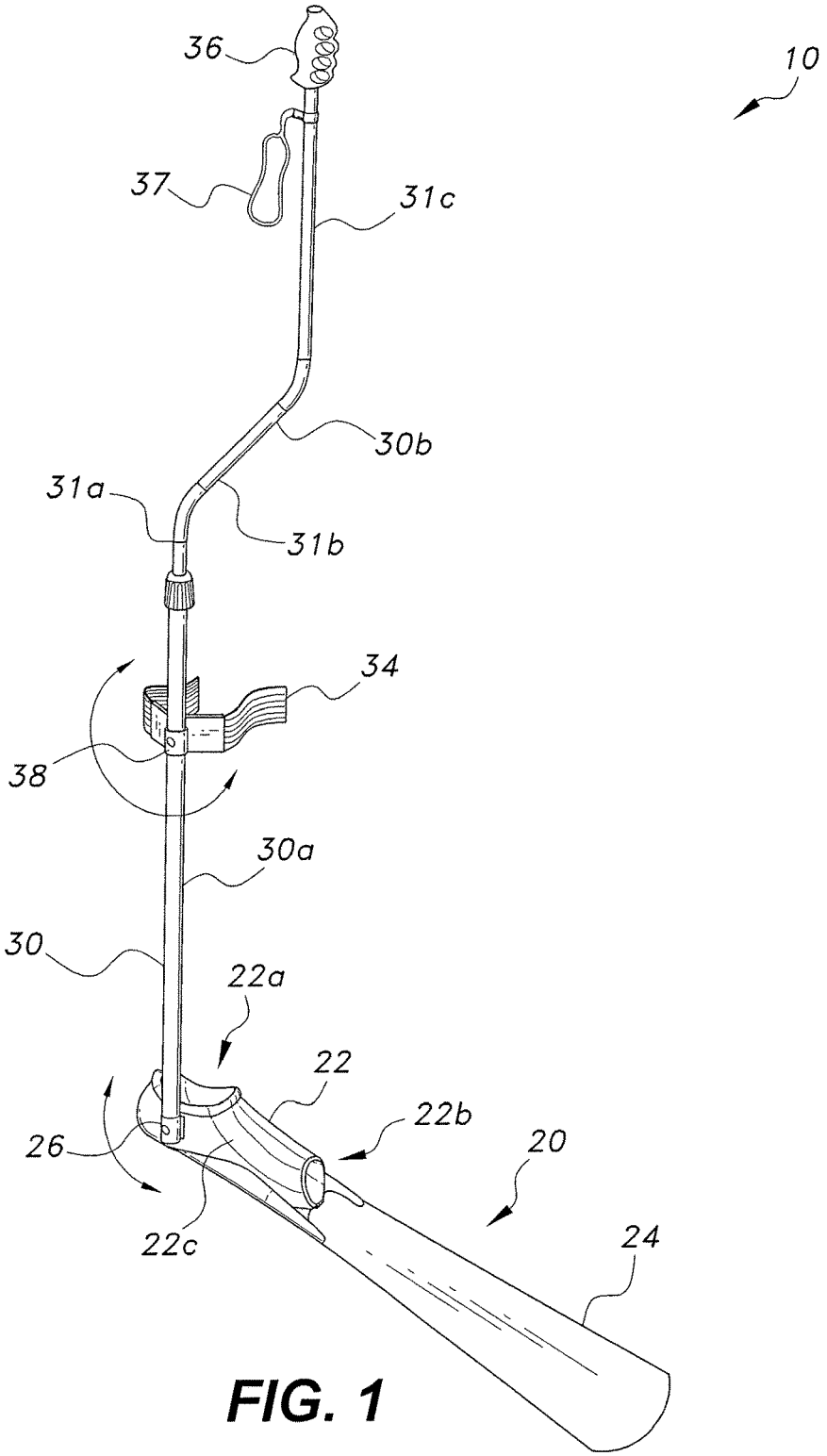
FIG. 1 is a perspective view of a swimming fin for the disabled.
Figure 2:
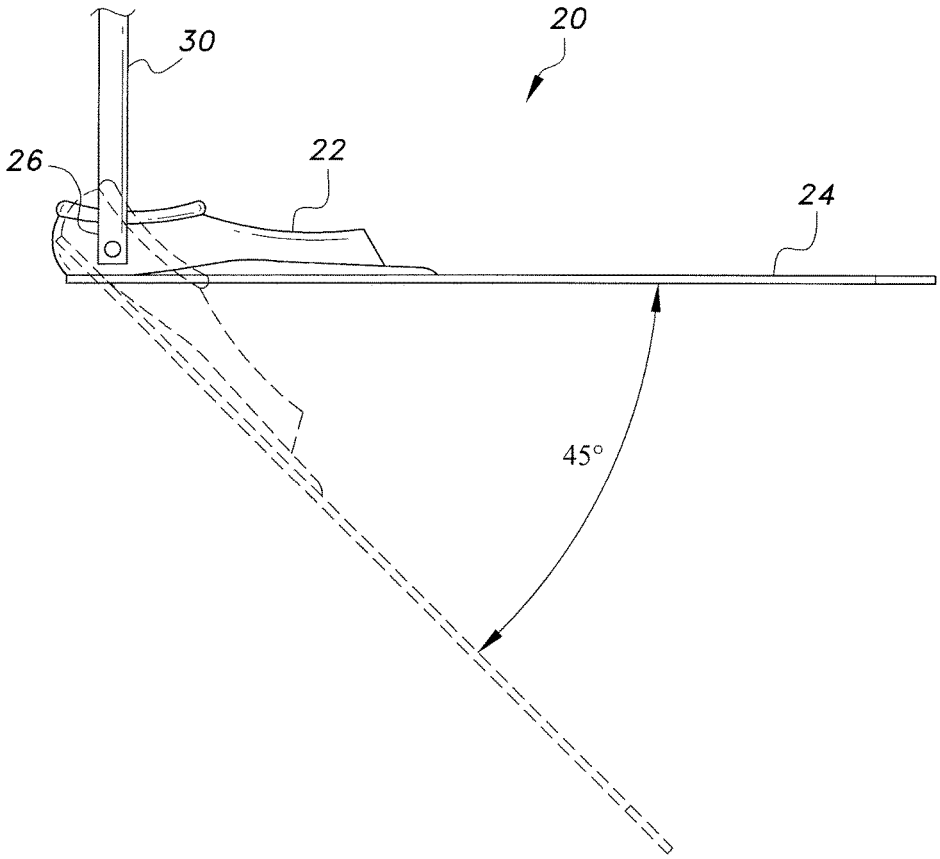
FIG. 2 is a partial side view of the swimming fin of FIG. 1, showing the flipper horizontal in solid lines and pivoted downward 45° in dashed lines.
Figure 3:
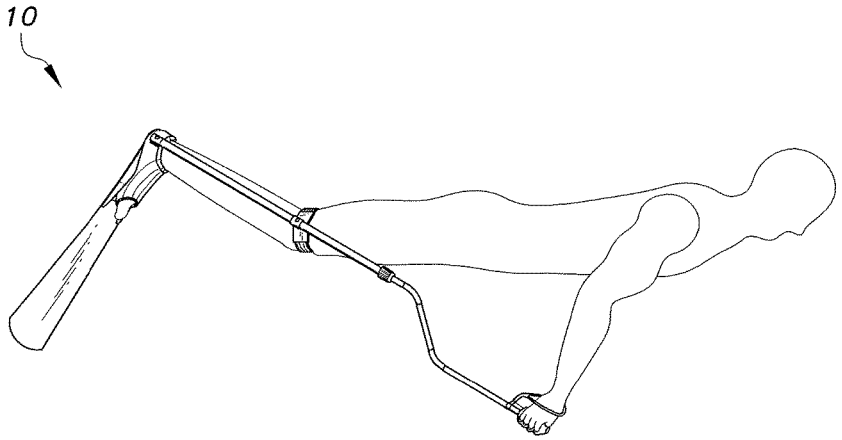
FIG. 3 is an environmental side view of the swimming fin of FIG. 1, showing use of the handle to pivot the user's lower leg at the knee while swimming.
Figure 4:
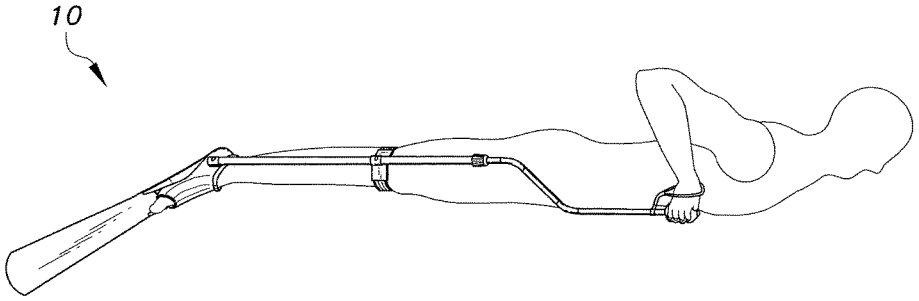
FIG. 4 is an environmental side view of the swimming fin of FIG. 1, showing use of the handle to straighten the leg while swimming to finish the leg kick begun in FIG. 3.

The swimming fin for the disabled 10 is shown in FIGS. 1-4. The fin 10 includes a flipper 20 pivotally attached to a lower end of a pole or post 30, the post 30 having a hand grip or handle 36 on the end opposite the flipper 20. A strap 34 is pivotally attached to the lower end of the post 30 for securing the post 30 to a user's leg, preferably around the knee. A user attaches the device to themselves by inserting their foot in the flipper 20, connecting the strap 34 to their leg, and gripping the handle 36. When in the water, pushing the handle 36 out or away from the user's chest (as shown in FIG. 3) and then pulling the handle 36 back to the chest (as shown in FIG. 4) will cause a motion in the user's leg similar to kicking, thus allowing a user with limited or no function in his or her leg to propel him/herself forward.

As shown in FIG. 1, the flipper 20 may include a boot 22 (or the upper of a boot) and a fin 24. The boot 22 includes an opening 22*a* for inserting the foot, a toe hole 22*c*, and a body 22*b* between the holes 22*a*, 22*c* forming an upper attached to the fin 24, similar to the upper attached to the sole of a shoe. The fin 24 extends out from the front of the boot 22 and tapers or fans outward from the boot 22 to the end of the fin 24 opposite the boot 22. The fin 24 provides a large surface that is pushed against the water to create propulsion. The boot 22 size can be varied for users with different foot sizes, or made adjustable so that a single boot 22 can be adjusted for differently sized feet. The size of the fin 24 may be increased to better transmit power to the water or, alternatively, decreased for better control. It is contemplated that any swimming flipper 20 known in the art may be used as the flipper 20. It is further contemplated that the boot 22 or the full flipper 20 be reinforced with a second, stiffer material to assist in evenly transferring forces from the post 30 throughout the flipper 20.

The lower end of the post 30 has a ferrule pivotally connected to a lateral side wall of the boot 22 near the heel of the boot 22. The pivot joint 26 is designed to have 45° of motion. As seen in FIG. 2, the 45° range of motion begins when the flipper 24 is perpendicular to the post 30 and extends downward 45°. The rotation enables easy movement of the flipper(s) 20 when swimming. The range of motion may be increased or decreased, based on user preference. It is contemplated that the pivot joint 26 may be lockable at the position angled downward to create more thrust during operation. This locking option may be used by users who have limited function in their legs. The pivot joint 26 may include a pin extending out from the boot 22 that is inserted through the ferrule (when so equipped) and through a hole in the post 30. The rotation may be limited by secondary posts on the boot 22 that interfere with the post 30 at the ends of the range of motion, or by an internal hinge mechanism. Alternatively, the ferrule may pivot across a plate fixed to the boot 22, the plate having a stop projecting therefrom to prevent rotation of the ferrule greater than 45°. In another alternative, the pivot joint 26 may include a gear that is attached to the boot 22 and then connected to the handle 36, e.g., by a cable. The optional locking mechanism may include a peg or detent pin on one side of the pivot joint 26 and multiple holes on the other, with the peg releasable via a cable attached to a button on the handle 36.

The post 30 includes a linear lower end portion 30*a* and a central section 30*b* having a medial bend forming an angled offset portion 31*b*. The linear lower end portion 30*a* is dimensioned and configured to extend up a user's leg past the knee. The central section 30*b* has a linear lower end 31*a* below the medial bend that telescopes into the linear lower end portion 30*a* to give the post 30 length adjustability. Length adjustment will allow users of different height or with different arm lengths to adjust the length of the post 30 to fit their preferred range of motion. The linear portion 30*a* and the central section 30*b* can be locked at a desired length by a friction lock or other locking mechanisms known in the art for locking telescopic members. The post 30 may be made from stainless steel, aluminum, titanium, or polyvinyl chloride (PVC). It is preferred that the post 30 is rigid enough to minimize bending when in use to produce efficient power transfer from the handle 36 to the flipper 20. The diameter, wall thickness, or material of the post 30 may be adjusted for users of different strengths or weights to optimize rigidity versus weight. The post 30 may have a length between two and six feet.

The medial bend of the central section 30*b* in the post 30 ends in a linear upper portion that is connected to a linear upper section 31*c* of the post 30 that is parallel to the linear lower end portion 30*a*. The linear upper section 31*c* provides for the handle 36 to be parallel to the linear lower end portion 30*a*. The central section 30*b* is designed to displace the handle 36 to a location forward from a longitudinal axis of the linear portion 30*a*. The forward displacement caused by the angled portion 30*b* will position the handle 36 in front of the user at a position that can be comfortably gripped and operated by the user. By locating the grip 36 in front of the user, the motion for swimming will involve pushing an arm forward, out or away from the chest, and pulling it back to the chest. Since this is a commonly used movement by most people, a user will typically have built up strength for this motion and will be able to easily repeat it. The embodiment shown in FIGS. 1-4 shows the angled portion 30*b* about 45° offset from the linear portion 30*a*. It is contemplated that the offset may be in the range of 30° to 90°, depending on the amount of vertical offset needed and the length of the angled portion.

An elastic strap 34 is pivotally attached to the linear portion 30*a* of the post 30 by a mounting bracket or the like, with the pivot 38 rotating around a longitudinal axis of the linear portion 30*a* of the post 30. The strap 34 is designed to wrap around a user's leg at a location proximate the knee, or at the center of the knee, and may be fastened with mating patches of hook and loop fastening material. The patellar location allows for easy control of the user's lower leg by the handle 36, and also takes stress off the ankle joint. The strap 34 is positioned on the side of the post 30 and has a range of motion a little greater than 45°. The range of motion extends 25.5° forward and 25.5° backward. By pivoting, the strap 34 enables easy movement of the flipper(s) 22 while swimming. The strap 34 may be made of interwoven strands of rubber (natural or synthetic) and synthetic fabric, or any known strap material in the art. Other examples of the strap material include an elastic band, a leather strip, and a neoprene strip. Examples of the fastener for the strap 34 include hook and loop fasteners, belt buckles, and tie-able laces. It is contemplated that the height of the strap 34 on the post 30 is adjustable for users with different length legs.

A handgrip or handle 36 is attached to the upper end of the post 30 to assist the user in gripping the post 30. The exemplary handle 36 shown in FIG. 1 includes four holes to accept each of the user's fingers, excluding the thumb. A lower portion of the grip 34 tapers outwards to support a base of the hand. It is contemplated that any known grip in the art may be used, for example grips used for ski or hiking poles.

A wrist strap or loop 37 is connected to the post 30 proximate the handle 36 for being worn around a user's wrist. The loop 37 prevents the user from losing the post 30 when he/she drops the handle 36. The loop 37 may be made out of an elastic material, such as neoprene or rubber, or alternatively, from stiffer material, such as woven nylon. The size of the loop 37 may also be adjustable to allow the loop 37 to be tightened around a user's wrist.

FIGS. 3 and 4 show a user swimming with the swimming fin for the disabled 10. A first position is shown in FIG. 3. In the first position, the user's arm is extended out from the chest, causing the user's lower leg to pivot upward. The strap 34 provides a fulcrum, and attachment of the lower end of the post 30 near the heel of the boot causes the flipper 20 to pivot in an arc, the lower leg pivoting at the knee. From this position, the user will pull their arm inwards, causing the leg to kick downward to straighten the leg, as shown in FIG. 4. The downward kick will emulate a kick of a swimmer with fully functioning legs and produce thrust by causing the fin 10 to push water backwards. To return to the first position, the user pushes their arm forward, causing the lower leg to pivot upward. This motion causes the fin to pivot to the position where it is substantially perpendicular to the user's shin, as seen in FIG. 3. The locking feature may be used to prevent the fin from pivoting when moving from the second position to the first position. By remaining at a rigid angle, more water can be displaced by the fin 10, resulting in greater thrust. FIGS. 3 and 4 show the user with only a single swim fin for clarity. In use, a user would have a fin 10 on each foot, and each hand would power their respective fins 10 via respective posts 30. The arms would be moved alternately, for example, when the right arm pushes out the left arm would pull in.

It is to be understood that the swimming fin for the disabled is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A swimming fin for a disabled person, comprising:

a flipper having:

a bottom fin portion; and a boot portion having an upper attached to the bottom fin portion, the upper having a heel portion and defining an opening for inserting a disabled person's foot into the boot portion and defining a toe hole, the bottom fin portion having a width fanning outward extending away from the boot portion;

a post having an upper end and a lower end, the lower end being pivotally attached to the flipper near the heel portion of the boot;

a leg strap pivotally attached to the post, the leg strap being adapted for being fastened around a leg of a disabled person; and a handle attached to the upper end of the post;

wherein using the handle to move the upper end of the post away from the disabled person followed by pulling the upper end of the post back towards the disabled person pivots the disabled person's leg in a leg kick motion while swimming.

2. The swimming fin according to claim 1, wherein the post has a central section between the upper end and the lower end, the central section having a medial bend bringing the upper end medially inward and forward parallel to the lower end, thereby making it easier for the disable person to grip the handle and manipulate the upper end of the post.

3. The swimming fin according to claim 2, wherein the central section has a linear lower end below the medial bend, the linear lower end of the central section adjustably telescoping into the lower end of the post so that the post has adjustable length.

4. The swimming fin according to claim 2, wherein the medial bend defines an angle of 45° between the central section and the lower end of said post and an angle of 45° between the central section and the upper end of said post.

5. The swimming fin according to claim 1, further comprising a ferrule pivotally attached to the boot near the heel portion, the lower end of said posted being inserted into the ferrule.

6. The swimming fin according to claim 1, said flipper is pivotal between a position normal to the lower end of said post and a position sloping downward from said post at an angle of 45°.

7. The swimming fin for the disabled according to claim 1, wherein the leg strap is elastic.

8. The swimming fin according to claim 1, wherein said handle comprises a hand grip.

9. The swimming fin according to claim 1, further comprising a wrist strap attached to said post adjacent said handle.

* * * * *